US012677899B1

(12) United States Patent
Alnasser et al.

(10) Patent No.: US 12,677,899 B1
(45) Date of Patent: Jul. 14, 2026

(54) WEARABLE PROTECTION FOR OUTDOOR WORKERS

(71) Applicant: Imam Abdulrahman Bin Faisal University, Dammam (SA)

(72) Inventors: Adim Baqer Alnasser, Qatif (SA); Hala El-Wakeel, Dammam (SA); Najla Alrumaihi, Dammam (SA); Noran Kattan, Dammam (SA); Bothaina Rafaa Alamri, Dammam (SA)

(73) Assignee: Imam Abdulrahman Bin Faisal University, Dammam (SA)

( * ) Notice: Subject to any disclaimer, the term of this patent is extended or adjusted under 35 U.S.C. 154(b) by 0 days.

(21) Appl. No.: 19/322,765

(22) Filed: Sep. 9, 2025

(51) Int. Cl.
*A42B 3/00* (2006.01)
*A42B 3/04* (2006.01)
*A42B 3/10* (2006.01)

(52) U.S. Cl.
CPC ..... *A42B 3/105* (2013.01); *A42B 3/0406* (2013.01)

(58) Field of Classification Search
CPC ..... A42B 3/105; A42B 3/0406; A42B 1/018; A42B 1/0186; A42B 1/06; A42B 1/24; A42B 1/0187; A41D 13/0512
See application file for complete search history.

(56) References Cited

U.S. PATENT DOCUMENTS 1,202,513 A * 10/1916 Gudger ..... A42B 1/247 2/10
1,764,500 A * 6/1930 Blakesley ..... A61F 9/025 131/237
1,955,232 A * 4/1934 Gallaway ..... G02C 3/02 2/10
2,025,772 A * 12/1935 Punton ..... A42B 3/105 2/5
2,055,560 A * 9/1936 Rose ..... A42B 1/0187 2/172
2,192,341 A * 3/1940 Dahlberg ..... A42B 1/0187 2/172

(Continued)

FOREIGN PATENT DOCUMENTS

CN 211323221 U 8/2020
CN 213074639 U 4/2021
CN 214340412 U 10/2021

OTHER PUBLICATIONS

Milwaukee, "Bolt Yellow High Visibility Mesh Sunshade with 50+UPF UV Protection", The Home Depot; 4 pgs.

*Primary Examiner* — Richale L Quinn
(74) *Attorney, Agent, or Firm* — Oblon, McClelland, Maier & Neustadt, L.L.P.

(57) ABSTRACT

A wearable protective apparatus for outdoor workers includes a helmet having a rigid shell, a cape configured to provide sun shading, and a guide mechanism integrated into the helmet. The cape is operably mounted on the guide mechanism. The guide mechanism is configured to enable the cape to slide or rotate around a major portion of a perimeter of the helmet to selectively cover one or more of a user's neck, ears, and upper back. The cape is directly attachable to the guide mechanism without requiring external mechanical connectors. The helmet provides impact protection to the user's head, while the cape shields the neck, ears, and upper body from sun exposure, dust, and other environmental elements, thereby offering comprehensive protection for outdoor workers.

19 Claims, 13 Drawing Sheets

(56) References Cited

U.S. PATENT DOCUMENTS 2,344,811 A * 3/1944 Gill ..... A42B 1/0187 2/457
2,472,033 A * 5/1949 Wetzel ..... A42B 1/014 2/4
2,743,454 A * 5/1956 Woodbury ..... A42B 1/0188 2/172
2,897,510 A * 8/1959 Forbes-Robinson .... A42B 1/06 2/172
3,016,545 A * 1/1962 Donahue ..... A42B 1/0182 2/10
3,205,508 A * 9/1965 Cox ..... A42B 3/105 2/205
3,387,304 A * 6/1968 Simpson ..... A42B 3/14 2/419
3,436,760 A * 4/1969 Molitoris ..... A42B 3/105 2/6.6
4,180,868 A * 1/1980 Snow ..... A42B 3/105 2/205
4,975,980 A * 12/1990 Ersteniuk ..... A62B 17/04 2/5
5,046,195 A * 9/1991 Koritan ..... A41D 20/00 2/916
5,121,507 A * 6/1992 Brown ..... A42B 1/004 2/172
5,355,535 A * 10/1994 Bruder ..... A42B 1/0187 2/172
5,448,778 A * 9/1995 Phillips ..... A42B 1/0187 2/172
5,471,684 A * 12/1995 Casale ..... A42B 1/0184 2/10
5,493,734 A * 2/1996 Nieves-Rivera ..... A42B 3/105 2/48
5,603,120 A * 2/1997 Gifford ..... A42B 3/105 2/172
5,613,246 A * 3/1997 Alexander ..... A42B 1/0184 2/10
5,649,327 A * 7/1997 Crewe ..... A42B 1/0187 2/172
5,655,225 A * 8/1997 Mathers ..... A42B 1/0187 2/172
5,669,074 A * 9/1997 Newman, Jr. ..... A42B 1/0187 2/172
5,694,648 A * 12/1997 Nucifora ..... A42B 1/0186 2/172
5,701,609 A * 12/1997 Bridges ..... A42B 3/16 2/172
5,715,534 A * 2/1998 Mobley ..... A42B 1/0184 2/10
5,870,772 A * 2/1999 Sprouse ..... A42B 1/0184 2/10
6,070,270 A * 6/2000 De La Torre ..... A42B 1/206 2/209.12
6,163,886 A * 12/2000 Carter ..... A42B 1/0187 2/172
6,263,508 B1 * 7/2001 Davis ..... A42B 1/0184 2/10
6,802,083 B2 * 10/2004 Yan ..... A42B 1/0187 2/209.13
7,240,373 B2 * 7/2007 Ahn ..... A42B 1/22 2/175.1
7,310,829 B1 * 12/2007 Engel-Wilson ..... A42B 1/0187 2/209.13
8,209,781 B2 * 7/2012 Krochmal ..... A42B 3/16 2/8.1
8,555,418 B2 * 10/2013 Singh ..... A42B 1/0186 2/173
8,943,614 B2 * 2/2015 Salinas ..... A42B 1/046 2/87
9,021,617 B2 * 5/2015 Asta ..... A42B 3/105 2/205
D738,597 S * 9/2015 Matullo ..... D2/882
D762,351 S * 8/2016 Lickteig ..... D2/891
D835,890 S * 12/2018 Swank ..... D2/891
10,219,569 B2 * 3/2019 Olivera, II ..... A42B 1/0184
10,362,825 B2 * 7/2019 Judge ..... A42B 1/0184
10,702,004 B2 * 7/2020 Gagliardo ..... A42B 3/04
10,757,993 B2 * 9/2020 Son ..... A42B 1/205
11,134,731 B2 * 10/2021 Hussey ..... A41D 13/1161
11,147,329 B2 * 10/2021 Gholson ..... A42B 1/205
11,510,449 B2 * 11/2022 An ..... A42B 1/18
11,547,880 B2 * 1/2023 Oliver, III ..... A41D 13/1153
11,930,873 B2 * 3/2024 Hodgdon ..... A42B 1/0187
2004/0040067 A1 * 3/2004 Pong ..... A42B 1/22 2/195.2
2006/0253957 A1 * 11/2006 Orozco ..... A42B 3/105 2/171
2010/0125930 A1 * 5/2010 Burrell, IV ..... A41B 13/08 2/243.1
2012/0216340 A1 * 8/2012 Asta ..... A42B 3/105 2/422
2013/0276215 A1 * 10/2013 Eley, Sr. ..... A42B 3/105 2/424
2013/0305436 A1 * 11/2013 Castillo ..... A63B 71/10 2/421
2013/0318685 A1 * 12/2013 Wood ..... A42B 1/0187 2/206
2015/0026872 A1 * 1/2015 Giroux Bernier ..... A42B 3/04 29/428
2015/0074879 A1 * 3/2015 Hillion ..... A42B 3/225 2/424
2015/0089709 A1 * 4/2015 DuCasse ..... A42B 1/0187 2/209.13
2019/0008227 A1 * 1/2019 Vilone ..... A42B 3/0406
2021/0045484 A1 * 2/2021 An ..... A42B 1/18
2021/0093032 A1 * 4/2021 Pakula, Jr. ..... A42B 1/18
2021/0378340 A1 * 12/2021 Capobianco ..... A42B 3/105
2022/0192286 A1 * 6/2022 Spence ..... A41D 13/0556
2023/0066913 A1 * 3/2023 Perez ..... A41D 13/1107
2025/0302135 A1 * 10/2025 Kemilä ..... A42B 1/0184
2025/0325063 A1 * 10/2025 Brooks ..... A42B 1/0184

* cited by examiner

WEARABLE PROTECTION FOR OUTDOOR WORKERS

BACKGROUND

Technical Field

The present disclosure is directed to the field of safety helmets, and more particularly relates to a wearable protective apparatus for outdoor workers.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Construction work is often carried out under various environment conditions including prolonged exposure to direct sunlight, and high temperatures. A safety helmet is a common Personal Protective Equipment (PPE) used in such environment conditions. Traditional safety helmets prevent injuries that may result from falling objects, collisions, or head contact with stationary objects or structures. These safety helmets are designed to protect workers from head injuries caused by falling objects, impacts, and electrical hazards commonly found on construction sites. The design of traditional safety helmets prioritizes durability, comfort, ventilation, and basic head protection functionality.

Conventional helmets often fall short in address conditions related to intense sunlight exposure, ultraviolet radiations and high temperatures. During the summer season, outdoor workers experience heat stress that can significantly reduce their physical performance. Further, the outer shell of conventional helmets is typically made from high-density polyethylene (HDPE) which provides excellent impact resistance and is lightweight yet very strong. However, such conventional helmets do not provide adequate protection for sensitive body areas such as the neck, ears, and upper back that remain exposed to direct sunlight and ultraviolet radiation during outdoor work activities.

Some known helmet design has sunshade functionalities. However, these helmets have only limited sunshade functionality. Sensitive body areas remain exposed while working in outdoor environment conditions. Such conventional designs typically provide fixed sunshade elements that cannot be adjusted based on changing sun positions or work orientations, and often require separate hooks or fasteners for attachment, making them cumbersome to use and maintain.

CN213074639U describes a solar protection device comprising a safety helmet, a plurality of bleeder vents, four fixed frames, and an apron connected by a round pin axle. The device uses block rubber to block the bleeder vents in rainy weather to prevent water from entering the helmet. This configuration is intended to provide protection from both sun and rain. However, this reference does not describe a guide mechanism integrated into the helmet that enables a cape to slide or rotate for selective and adjustable coverage.

CN211323221U discloses a cool type operation safety helmet that includes a safety helmet body having a cap shell, a brim, a cap liner, and a back hoop. The helmet body is provided with a wind channel and an inside groove that forms a lug on the cap shell, with the axis of the groove being arcuate. This structure is intended to provide a good radiating effect for the user. However, this reference does not describe a guide mechanism integrated into the helmet that enables a cape to slide or rotate for selective and adjustable coverage.

CN214340412U discloses a helmet structure including a shell, an interior helmet, and a detachable neck scarf. The structure includes a plurality of elasticity shock attenuation rubber balls between the shell and the interior helmet, and the inner helmet has a plurality of air holes. This design is intended to avoid direct sun irradiation on the neck and improve ventilation and damping performance. However, this reference does not describe a guide mechanism integrated into the helmet that enables a cape to slide or rotate for selective and adjustable coverage.

Each of the aforementioned references suffers from one or more drawbacks hindering their adoption, such as limited protection and sunshade features. Specifically, these references fail to provide a wearable protective apparatus that combines effective head protection with an adjustable sun shading system that can be easily manipulated by the user without tools, and that provides comprehensive coverage for the neck, ears, and upper back areas. There is a need for occupational safety equipment that provides effective solution to the construction workers working in various environment conditions. Accordingly, it is one object of the present disclosure to provide a wearable protective apparatus for outdoor workers that addresses both impact and environmental protection problems.

SUMMARY

In an exemplary embodiment, a wearable protective apparatus is described. A wearable protective apparatus for outdoor workers includes a helmet having a rigid shell configured to protect a user's head, a cape configured to provide sun shading for the user, a guide mechanism integrated into the helmet, the cape being operably mounted on the guide mechanism, wherein the guide mechanism is configured to enable the cape to slide or rotate around a major portion of a perimeter of the helmet to selectively cover one or more of the user's neck, ears, face, or upper back region, and wherein the cape is directly attachable to the guide mechanism without requiring external mechanical connectors.

In some embodiments, the guide mechanism comprises a curved rail extending along a rear and lateral portion of the rigid shell.

In some embodiments, the curved rail includes an access opening configured for inserting or removing the cape.

In some embodiments, the curved rail includes one or more integrated mechanical connectors selected from the group consisting of brackets, snap-fit connectors, loops, slide clips, hooks, including a rail hook.

In some embodiments, the cape comprises a soft, breathable fabric body.

In some embodiments, the cape further comprises a reflective strip disposed along a lower edge of the fabric body.

In some embodiments, a rail hook is configured to slide along the curved rail of the guide mechanism.

In some embodiments, the rail hook is integrally formed with a cape attachment portion configured to secure a fabric body without separate hooks or fasteners.

In some embodiments, the rail hook comprises a quick-release design that enables tool-free detachment of the cape from the helmet.

In some embodiments, the rail hook is compatible with multiple types of cape fabric.

In some embodiments, the rail hook is interchangeable with at least one connector selected from the group consisting of snap-fit connectors, slide clips, brackets, and loops.

In some embodiments, the apparatus further comprises a storage compartment integrated within the rigid shell.

In some embodiments, the storage compartment is positioned along the perimeter of the rigid shell.

In some embodiments, the storage compartment has sufficient volume to contain the cape when not in use.

In some embodiments, the guide mechanism comprises a track that allows both linear sliding and rotational movement of the cape.

In some embodiments, the track is substantially C-shaped.

In some embodiments, the cape is configured to selectively cover only a portion of the user's neck, ears, face, or upper back based on user adjustment.

In some embodiments, the cape is movable to a fixed position around the helmet using a positional locking feature of the guide mechanism.

In some embodiments, the cape includes eyelets or attachment points that align with the one or more integrated mechanical connectors.

In some embodiments, the guide mechanism is integrally molded into the helmet shell.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
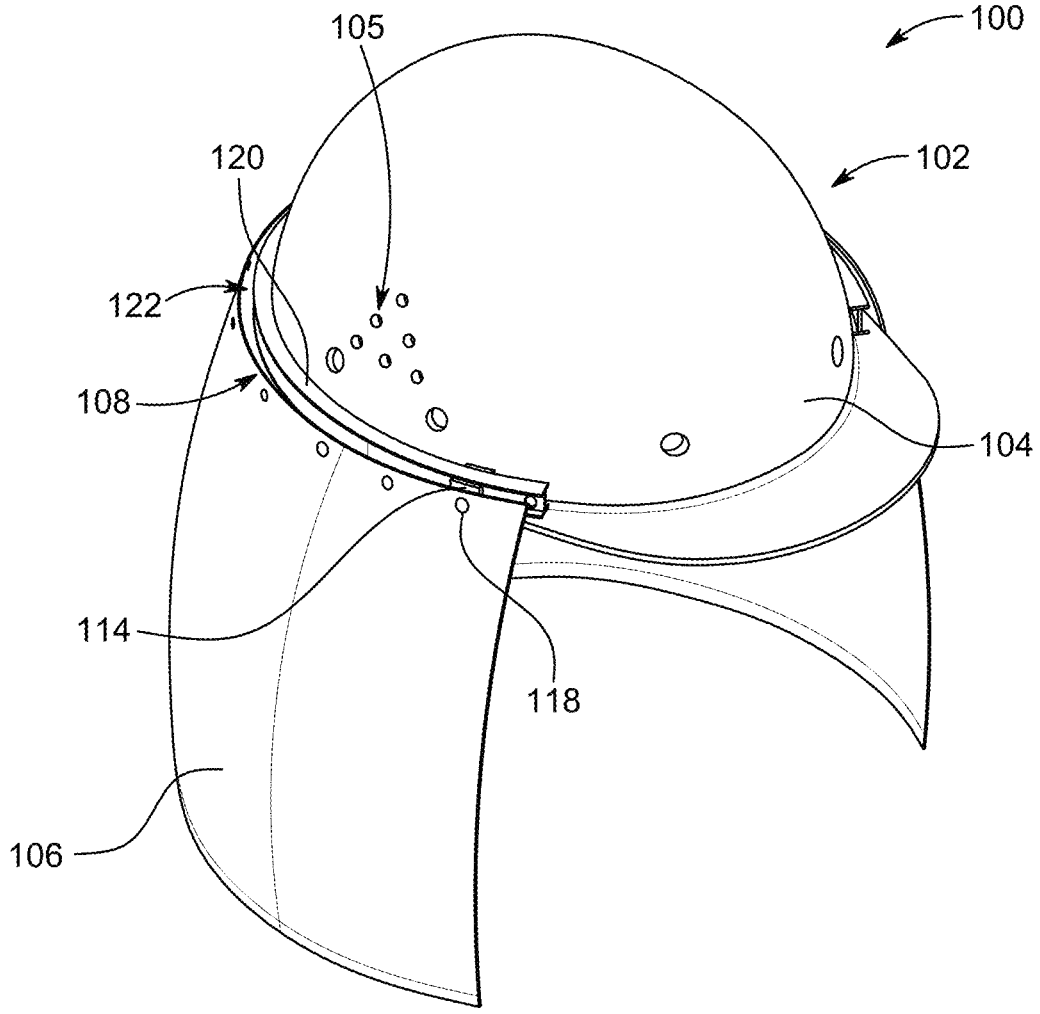
FIG. 1A is a perspective view of a wearable protective apparatus for outdoor workers, according to certain embodiments.

In the drawings, like reference numerals designate identical or corresponding parts throughout the several views. Further, as used herein, the words "a", "an" and the like generally carry a meaning of "one or more", unless stated otherwise.

Furthermore, the terms "approximately," "approximate", "about" and similar terms generally refer to ranges that include the identified value within a margin of 20%, 10%, or preferably 5%, and any values therebetween.

Aspects of this disclosure are directed towards a wearable protection apparatus for outdoor workers. The present disclosure provides a technical solution to the problem of sun shading that can be used with Personal Protective Equipment (PPE), such as hardhats. The apparatus provides protection from the heat and sunlight in outdoor work environments. The wearable protective apparatus integrates multiple interconnected components that work together to provide both impact protection and environmental protection for outdoor construction workers who are exposed to prolonged sunlight, high temperatures, and ultraviolet radiation. The wearable protective apparatus addresses the dual requirements of occupational safety through head impact protection and worker comfort through adjustable solar radiation shielding.

Figure 1B:
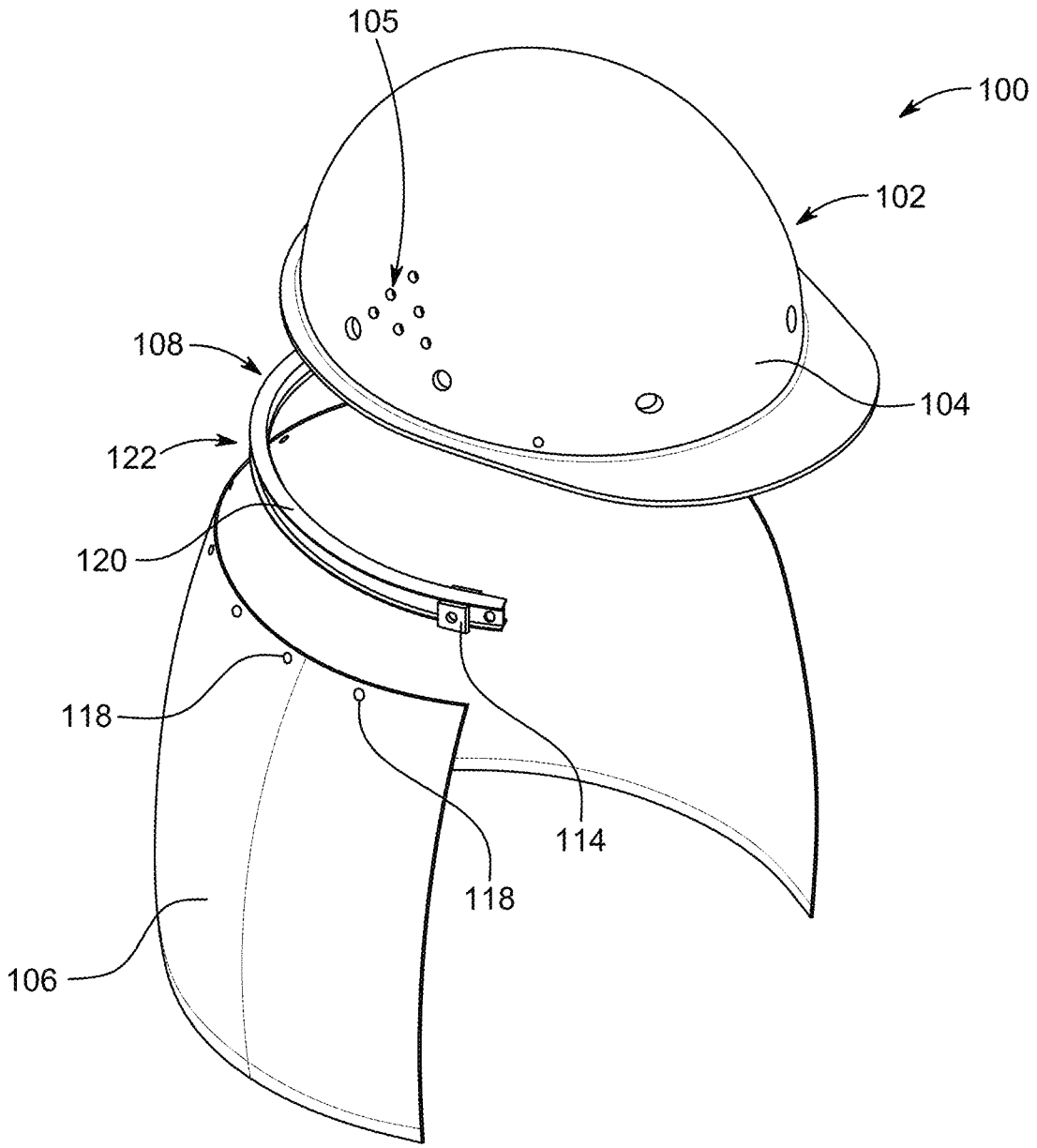
FIG. 1B is an exploded view of the wearable protective apparatus for outdoor workers, according to certain embodiments.

Referring to FIGS. 1A and 1B, illustrated are different views of a wearable protective apparatus (as represented by reference numeral 100, and hereinafter sometimes referred to as "apparatus 100") for outdoor workers. The apparatus 100 of the present disclosure provides an integration of head protection with advanced sun shading capabilities. The apparatus 100 comprises multiple interconnected components that provide protection for outdoor construction workers. The apparatus 100 provides a unified system where traditional helmet functionality is enhanced through the integration of adjustable environmental protection features.

As illustrated, the wearable protective apparatus 100 comprises a helmet 102 having a rigid shell 104 configured to protect a user's head, a cape 106 configured to provide sun shading for the user, and a guide mechanism 108 integrated into the helmet 102, the cape 106 being operably mounted on the guide mechanism 108, wherein the guide mechanism 108 is configured to enable the cape 106 to slide or rotate around a major portion of a perimeter of the helmet 102 to selectively cover one or more of the user's neck, ears, face, or upper back region, and wherein the cape 106 is directly attachable to the guide mechanism 108 without requiring external mechanical connectors.

Herein, the helmet 102 may be a form of protective gear worn to protect the head from injuries such as impact from falling objects, collisions, or protection in construction environment conditions. In an example embodiment, the helmet 102 may correspond to a standard industrial helmet. In another example embodiment, the helmet 102 may be a construction safety helmet designed for use in outdoor environments. The helmet 102 may be a standalone protective helmet. The helmet 102 functions as the primary structural foundation for the wearable protective apparatus 100, providing both impact protection capabilities and serving as the mounting platform for the environmental protection components.

The helmet 102 may be positioned at the uppermost portion of the wearable protective apparatus 100 and configured to protect a user from head injuries caused by falling objects on construction sites. The positioning of the helmet 102 establishes the reference framework for the attachment and operation of the guide mechanism 108 and cape 106. The helmet 102 serves as the central component around which other elements of the wearable protective apparatus 100 are organized and integrated.

Figure 1C:
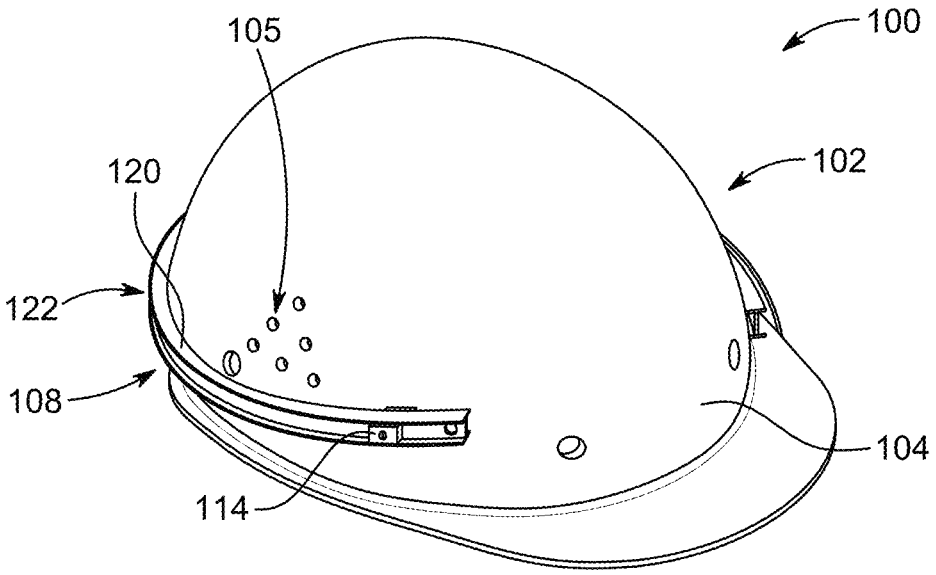
FIG. 1C is an exploded view of the wearable protective apparatus for outdoor workers, according to certain embodiments.
Figure 1D:
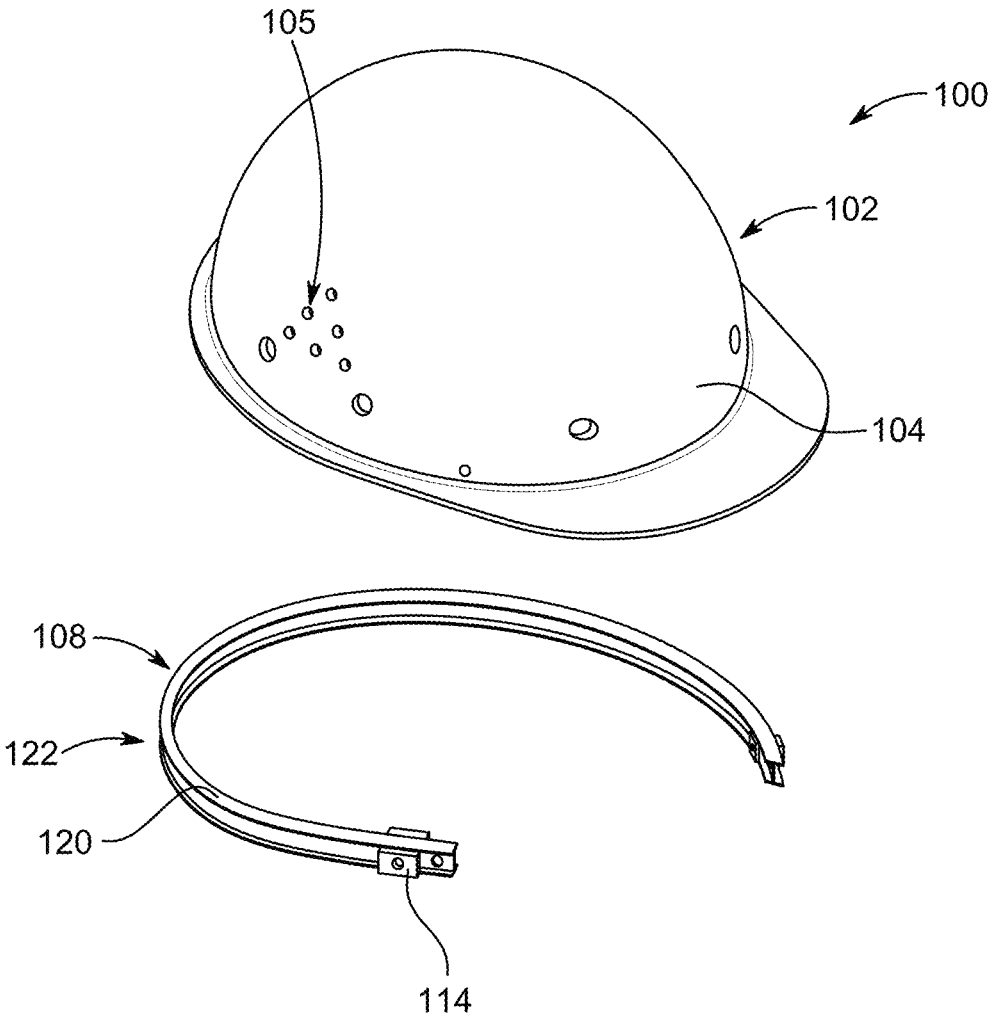
FIG. 1D is an exploded view of the wearable protective apparatus for outdoor workers, according to certain embodiments.

Referring to FIGS. 1C and 1D, illustrated are different views of a wearable protective apparatus (100) for outdoor workers. The embodiment shown in FIGS. 1C and 1D includes a the rigid shell 104, the guide mechanism 108 and the rail 120 integrated into the helmet 102. The guide mechanism includes a track 122 that is substantially C-shaped and includes the rail 120 which extends upwardly.

Figure 2A:
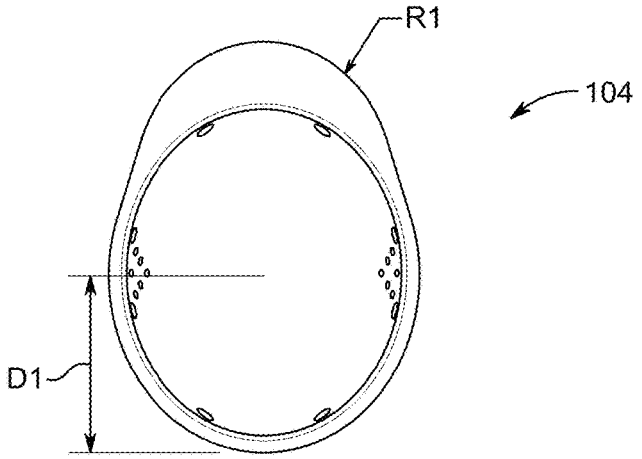
FIG. 2A is a top view of a helmet of the wearable protective apparatus for outdoor workers, according to certain embodiments.
Figure 2B:
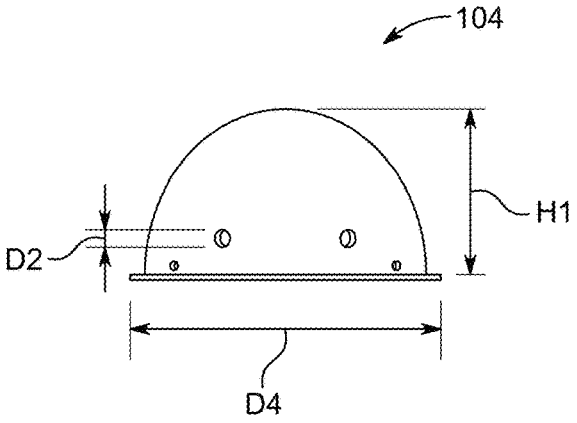
FIG. 2B is a front view of the helmet of the wearable protective apparatus for outdoor workers, according to certain embodiments.
Figure 2C:
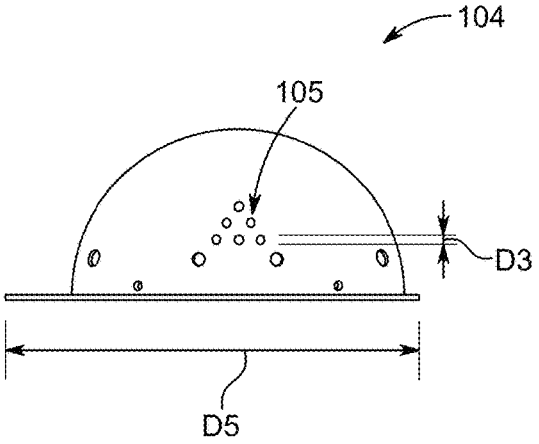
FIG. 2C is a side view of the helmet of the wearable protective apparatus for outdoor workers, according to certain embodiments.

In particular, as illustrated in FIGS. 2A-2C, the helmet 102 comprises the rigid shell 104. The rigid shell 104 may have a dome shaped structure. The rigid shell 104 provides the primary structural component of the helmet 102 and is specifically configured to distribute impact forces across its surface area to minimize transmitted force to the user's head. The rigid shell 104 has an elliptical or oval shape configuration that is designed to conform to the human head and provide a balanced fit to the user.

In some embodiments, the helmet 102 may be equipped with a suspension unit (not illustrated) configured to create a controlled gap between the rigid shell 104 and the user's head. The controlled gap within the suspension unit acts as a shock absorber and configured to dissipate the impact energy due to falling objects. The controlled gap reduces the transmitted force to the skull in the event of a collision or object strike on the helmet 102. The helmet 102 may further include internal foam cushion support to provide comfort to the user during prolonged wearing. In some implementations, the foam cushion support material may include expanded polystyrene (EPS) foam to act as a shock-absorbing layer, helping to distribute and reduce the force of impact if an object were to come into contact with the helmet 102. The helmet 102 may also include a plurality of ventilation holes 105 to enhance airflow and reduce internal heat buildup in outdoor environments. The helmet 102 may further include a plurality of mounting points to mount the guide mechanism 108 and the cape 106. The helmet 102 may be configured to enclose and protect the cranial region of the user's head from falling objects or collision that may occur in construction environments.

In an example embodiment, the rigid shell 104 has a radius of curvature 'R1' in the range of 90 to 100 millimeters, and in a non-limiting example, approximately 98 millimeters. Further, the helmet 102 may have a length 'D1' of approximately 140 mm along a major axis, a height 'H1' of approximately 130 mm, and a width 'D4' of approximately 238 mm at a narrower side and a maximum width 'D5' of approximately 320 mm. The rigid shell 104 may further have a thickness 'D2' of approximately 5 mm. Furthermore, herein, the plurality of ventilation holes 105 may have a diameter 'D3' of about 2.5 mm.

For present purposes, the helmet 102 may be prepared from a high-density polyethylene (HDPE). The high-density polyethylene (HDPE) may be used in the form of pellets loaded into a hopper of an injection molding machine. The HDPE may be heated to a molten state and then injected into a helmet mold under high pressure. The mold may be cooled and solidified to prepare the helmet 102. The helmet 102 may be subjected to a vent hole drilling process to create plurality of mounting holes for ventilation and to install one or more components, such as the guide mechanism 108 and the cape 106. The surface of the helmet 102 may be polished to apply a finish. The logos and safety marks may be applied on the helmet 102 through the laser etching process.

As discussed, the wearable protective apparatus 100 includes the guide mechanism 108 that is integrated into the helmet 102. The guide mechanism 108 is configured to provide support and attachment functionality for the cape 106 in the wearable protection apparatus 100. In some embodiments, the guide mechanism 108 may be mounted around the lower perimeter of the helmet 102. In an alternative embodiment, the guide mechanism 108 may be integrally molded into the helmet shell (i.e., the rigid shell 104). This can be achieved by forming the guide mechanism 108 as a feature of the rigid shell 104 during an injection molding process, creating a single, unified component. This configuration enhances durability and simplifies the overall construction of the apparatus 100.

Figure 3A:
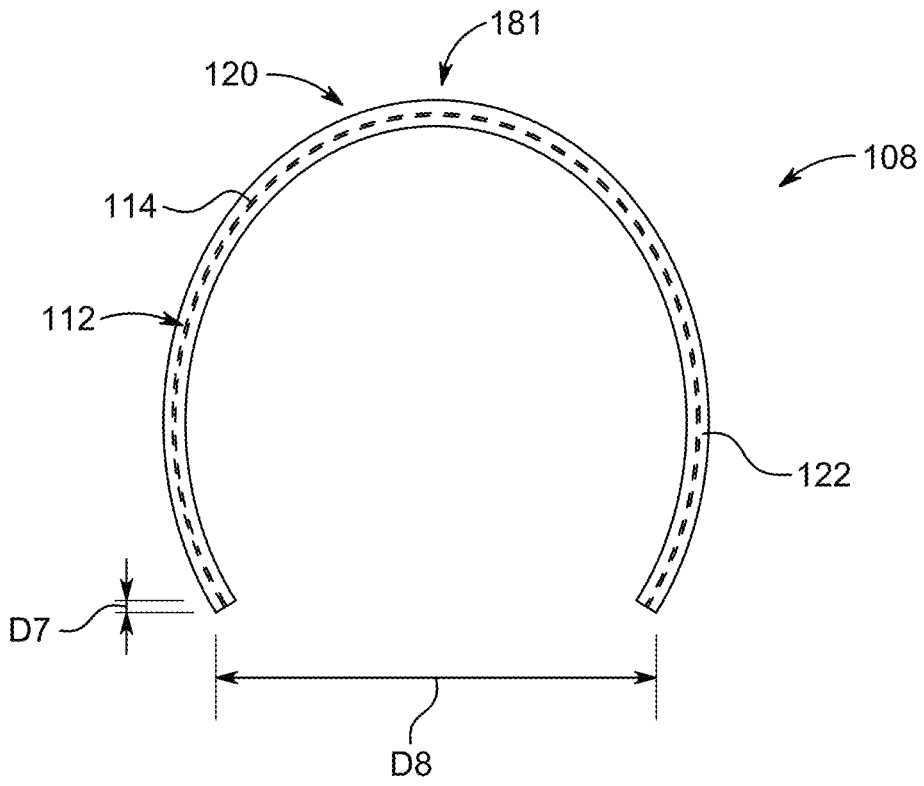
FIG. 3A is a top view of a curved rail of the wearable protective apparatus for outdoor workers, according to certain embodiments.
Figure 3B:
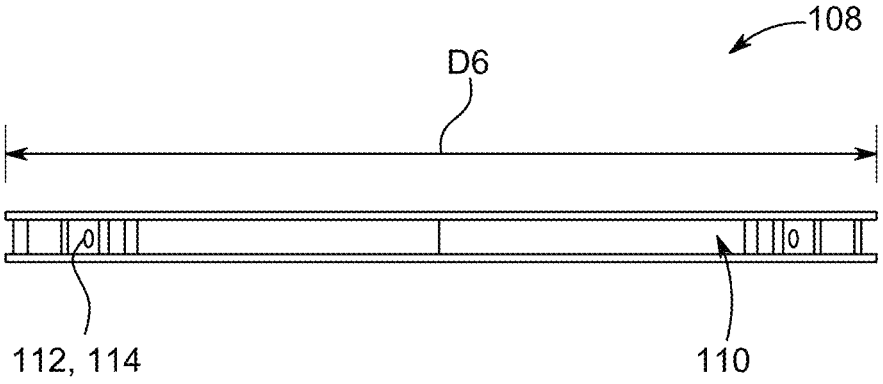
FIG. 3B is a sectional view of the curved rail of the wearable protective apparatus for outdoor workers, according to certain embodiments.
Figure 3C:
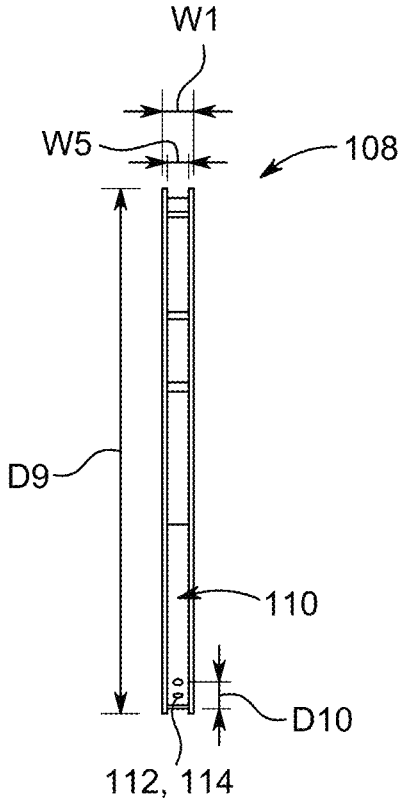
FIG. 3C is a sectional view of the curved rail of the wearable protective apparatus for outdoor workers, according to certain embodiments.

Referring to FIGS. 3A, 3B, and 3C, different views of the guide mechanism 108 are illustrated. As shown, the guide mechanism 108 comprises a curved rail 120 that extends along the rear and lateral portion of the rigid shell 104 of the helmet 102. The curved rail 120 extends along a major portion of the perimeter of the helmet 102 and is designed to provide a smooth internal surface that minimizes friction during use. In some implementations, the curved rail 120 may extend to a front portion of the rigid shell 104 of the helmet 102 to provide coverage to the face of the user. The guide mechanism 108 allows the cape 106 to be operably mounted. Specifically, the guide mechanism 108 is configured to enable the cape 106 to slide or rotate around the helmet 102.

Figure 3D:
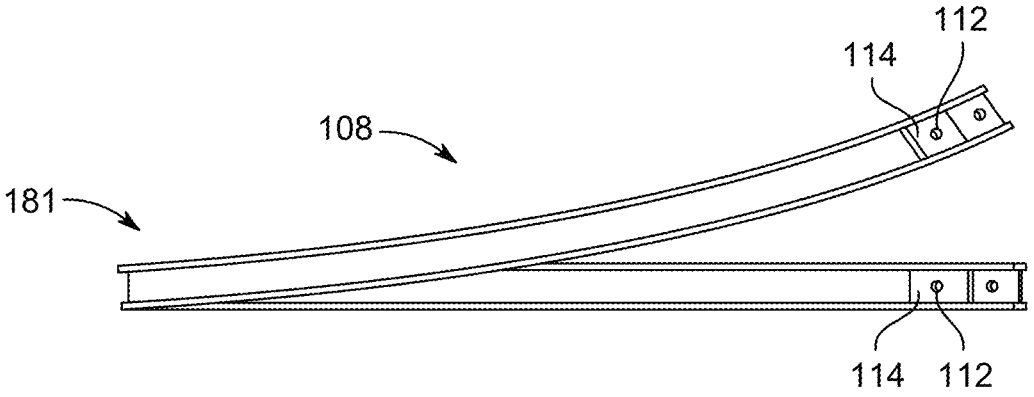
FIG. 3D is a side view of the curved rail of the wearable protective apparatus for outdoor workers, according to certain embodiments.

The curved rail 120 is a smooth, arc-shaped structure that extends along the rear and lateral perimeter of the helmet 102. The apex is identified as 181. The curved rail 120 may be manufactured from a lightweight plastic or an aluminum alloy, such as a 6061 or 5052 aluminum alloy, which provides durability, rigidity, and corrosion resistance. In an example manufacturing process, a heated aluminum alloy may be extruded through a die to form a profile, which is then cut into segments and curved using a rolling machine to conform to the shape of the helmet 102. The surface of the curved rail 120 may be anodized for additional corrosion resistance. FIG. 3D shows a side view of the rail 108 describing the upward bend of one of the arms of the C-shaped rail 120.

Herein, the guide mechanism 108 comprises of the rail 120 that further comprises a track 122. In some embodiments, the track 122 is substantially C-shaped. Specifically, the curved rail 120 comprises the C-shaped semi-rigid track 122. The track 122 is configured to allow both linear sliding and rotational movement of the cape 106 relative to the helmet 102. The track 122 is further configured to receive and guide one or more connectors attached to the cape 106. In present embodiments, the track 122 includes one or more integrated connectors 112. An integrated connector 112 is a mechanical connector that is formed as a part of, or permanently coupled to, the track 122 of the rail 120, and therefore both the track 122 and the rail 120 is a part of the guide mechanism 108. As shown in FIGS. 3A-3C, in an example configuration, the curved rail 120 may have an outer width 'D6' of approximately 237.99 mm, an inner width 'D8' of approximately 191.06 mm, and a height 'D9' of approximately 218 mm. Further, the track 122 may have a wall thickness 'D7' of approximately 4.63 mm and an overall thickness 'W1' of approximately 12 mm, with an inner thickness 'W5' of approximately 10 mm. A depth 'D10' of the track 122 may be approximately 2.5 mm.

In some implementations, the guide mechanism 108 may include one or more detents, stops, or frictional elements along the track 122 to selectively retain the cape 106 in predetermined positions, thereby allowing the cape 106 to remain secured at a desired location while permitting manual adjustment by the user. Additionally, a stopping mechanism may be disposed at an end of the curved rail 120 and/or track 122 as part of the guide mechanism 108 to prevent the cape from sliding beyond a desired position. In some examples, the stopping mechanism positioned at terminal ends of the curved rail 120 to prevent the one or more connectors from disengaging from the rail 120 during use. In some examples, the stopping mechanism comprises an enlarged end, raised lip, or tab formed integrally with the rail 120 to act as a physical barrier against further sliding movement of the one or more connectors. In some variations, removable or adjustable end caps are affixed to the terminal ends of the curved rail 120 to enclose the one or more connectors within the track 122 and permit disassembly for repair or replacement of the cape 106.

In some embodiments, the curved rail 120 includes an access opening 110 configured to allow insertion or removal of the cape 106. The access opening 110 may be located at one end of the curved rail 120 and may be in the form of a small opening or notch at the front of the track 122. The access opening 110 is configured to facilitate tool-free installation or replacement of the cape 106 during cleaning or when switching to an alternative material.

In a preferred embodiment, the curved rail 120 includes a portion that extends upward from a plane defined by left and right curves of the semicircular shape, as shown in FIG. 3A (top view). For example, the apex of the semicircle in the top view shown in FIG. 3A may curve upwardly out of a plane defined by the left and right sides of the curved rail 120. The upward curvature extends towards an apex (e.g., center point) of the wearable protective apparatus 100. The upward curve begins at a point no closer to the ends of the semicircular, curved rail 120 than ½ the distance from the apex of the semicircle to the ends of the semicircle. Preferably, the upward curve begins at a point ¾ or more of the distance from an end of the semicircular rail 120 to the apex of the semicircular rail 120. More preferably, the upward curve represents a bending of a rear portion of the plane of the rail at an angle of 5-15°, preferably about 10° out of the plane defined by the ends of the semicircle. The purpose of the upward curve is to maintain approximately equal portions of the cape on the left and right hand sides of the semicircular rail 120. The upward curvature is preferable in comparison to an immovable fastening point at which the cape is fastened at the apex which would otherwise eliminate the possibility of collecting the entire cape 106 on one end of the curved rail 120.

Figure 4A:
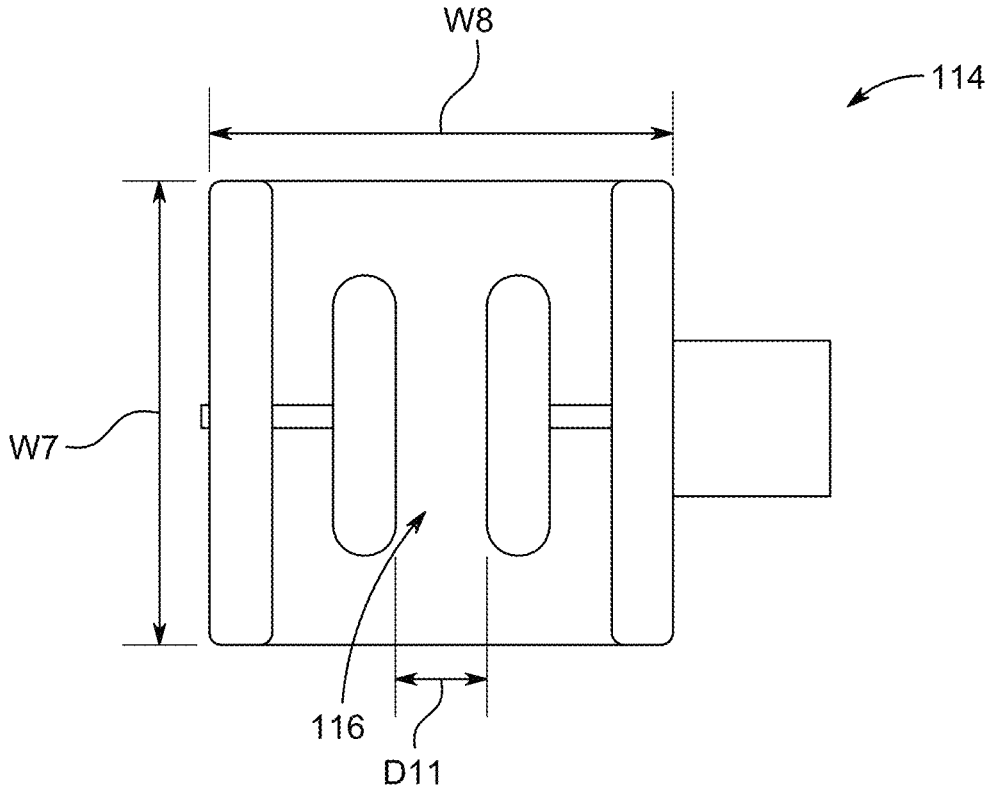
FIG. 4A is a side view of a rail hook of the wearable protective apparatus for outdoor workers, according to certain embodiments.
Figure 4B:
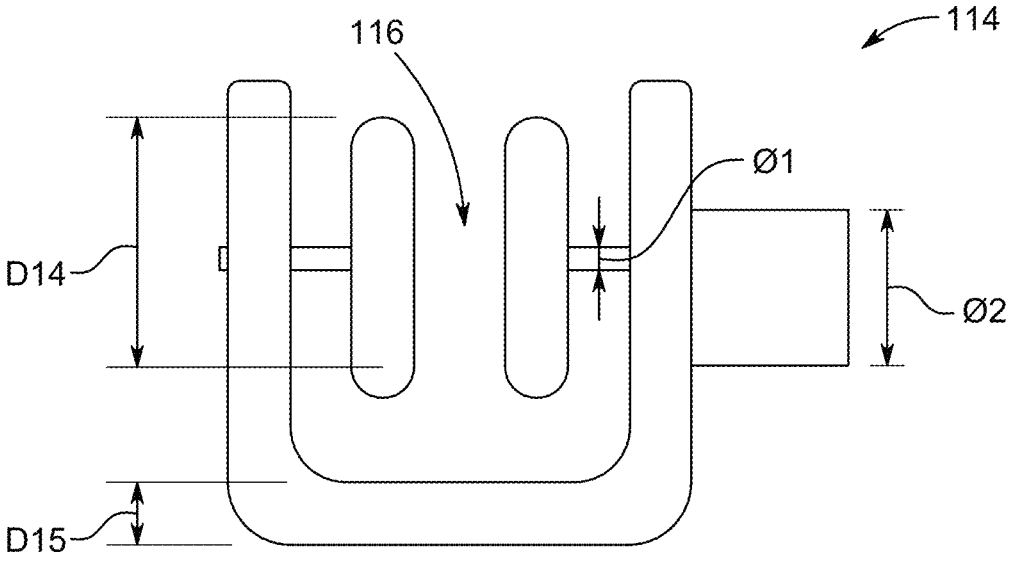
FIG. 4B is a side view of the rail hook of the wearable protective apparatus for outdoor workers, according to certain embodiments.
Figure 4C:
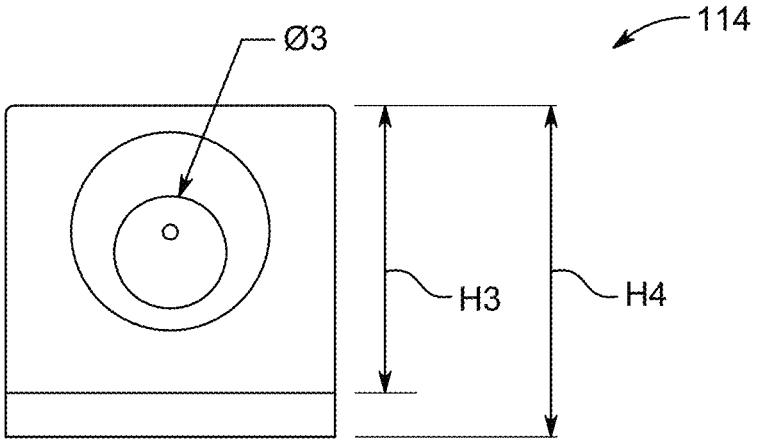
FIG. 4C is a front view of the rail hook of the wearable protective apparatus for outdoor workers, according to certain embodiments.

In present embodiments, the curved rail 120 includes one or more integrated mechanical connectors 112. Herein, the one or more integrated mechanical connectors 112 may be selected from the group consisting of brackets, snap-fit connectors, loops, slide clips, and hooks, including a rail hook. These integrated mechanical connectors 112 are disposed within the track 122 of the curved rail 120 that is a part of the guide mechanism 108 attached to the rigid shell 104 of the helmet 102. Integrated connectors 112 are positioned within the track 122 such that removal or replacement of the cape 106 does not remove the integrated connectors 112 from the track 122. For example, the integrated connectors 112 may include individual hooks that are disposed along the track 122 such that the cape 106 can be detached without removing the hooks from the track 122. In such cases, the hooks are considered an integrated connector 112 because they remain engaged with the track 122 of the curved rail 120 independently of the cape 106. In some embodiments, at least one of the integrated mechanical connectors 112 comprises a rail hook 114 configured to slide smoothly along the track 122 of the curved rail 120 which is a part of the guide mechanism 108. More specifically, a plurality of rail hooks 114 are attached to the cape 106, and these rail hooks 114 are configured to slide within the track 122 of the curved rail 120. Referring to FIGS. 4A, 4B, and 4C, different views of an example rail hook 114 are shown. The rail hook 114 is a mechanical connector that operates in the guide mechanism 108, providing both a track-sliding functionality and a cape attachment capability. As shown in FIGS. 4A-4C, the integrated connector 112 is a rail hook 114. The rail hook 114 may have a width 'W8' of approximately 15 mm, a length 'W7' of approximately 15 mm, and a total height 'H4' of approximately 15 mm. The rail hook 114 may further have dimensions, as shown, including a spacing 'D11' of about 3 mm, a prong length 'D14' of about 8 mm, a rail hook 114 material thickness 'D15' of about 2 mm, an exposed height 'H3' of about 13 mm, a diameter 'Ø1' of about 1 mm, a diameter 'Ø2' of about 6 mm, and a diameter 'Ø3' of about 5 mm. In some implementations, the one or more rail hooks 114 may include a locking mechanism to hold a specific position of the cape 106. For example, the rail hooks 114 may include a protrusion, notch, or widened section configured to interact with complementary features in the curved rail 120 to resist movement past a predetermined location.

In some embodiments, the rail hook 114 may have a width 'W8' within a range of about 12-18 mm, more preferably about 14-16 mm; a length 'W7' within a range of about 12-18 mm, more preferably about 14-16 mm; and a height 'H4' within a range of about 12-18 mm, more preferably about 14-16 mm. Further, the rail hook 114 may include additional dimensions, such as a spacing 'D11' within a range of about 2-4 mm, more preferably about 2.5-3.5 mm; a prong length 'D14' within a range of about 6-10 mm, preferably 7-9 mm; a rail hook 114 material thickness 'D15' within a range of about 1-3 mm, more preferably about 1.5-2.5 mm; an exposed height 'H3' within a range of about 11-15 mm, more preferably about 12-14 mm; a diameter 'Ø1' within a range of about 0.5-1.5 mm, more preferably about 0.8-1.2 mm; a diameter 'Ø2' within a range of about 5-7 mm, more preferably about 5.5-6.5 mm; and a diameter 'Ø3' within a range of about 4-6 mm, more preferably about 4.5-5.5 mm. These dimensions ensure that the rail hook 114, as well as any other integrated connector 112, fits within the track 122 of the rail 120, providing secure engagement while allowing sliding and repositioning of the cape 106 along the rail 120.

In some implementations, the integrated mechanical connectors 112 may be interchangeable, allowing a user to replace a rail hook 114 with another connector type (e.g., brackets, snap-fit connectors, loops, slide clips, other hooks) that is dimensioned to fit within the same track 122. Interchangeability does not render the mechanical connector "external." So long as it remains structurally constrained by and operable within the track 122 of the rail 120. This configuration provides flexibility for different cape types of connector geometries while maintaining secure engagement and guided sliding along the rail 120.

In such embodiments, the other integrated connectors 112 may be dimensioned to correspond generally to the dimensions of the rail hook 114 described above (e.g., 'W7', 'W8', 'H4', 'D11', 'D14', 'D15', 'H3', 'Ø1', 'Ø2', 'Ø3'), thereby allowing for compatibility and interchangeability of the components. The integrated connector 112 is configured to engage the track 122 formed in the rail 120 or structural element, such that the cape 106 remains secured during sliding movement while permitting selective repositioning along the rail 120.

For present purposes, the rail hook 114 is manufactured from polyoxymethylene (POM), also known as acetal. POM is selected for its low-friction properties, which support smooth sliding inside the curved rail 120. POM also offers high mechanical strength, wear resistance, and durability, and it handles heat and sunlight exposure without degrading, which reduces the risk of damage to the cape 106 or the guide mechanism 108. The rail hook 114 may be formed through an injection molding process.

In alternative embodiments, the cape 106 may be secured using external mechanical connectors that do not form part of the track 122 of the rail 120, which together the track 122 and the rail 120 comprise the guide mechanism 108. That is, the external connectors are not permanently a part of the rail 120. In some cases, the external connectors may temporarily engage the track 122; however, if removing the cape 106 also removes the connector from the track, the connector is considered an external connector rather than an integrated connector 112.

For example, the external connector can be attached to the cape 106 prior to engagement with the track 122 or the helmet 102. Examples of external connectors may include snap buttons, Velcro strips, hooks, or magnetic patches sewn, riveted, or otherwise affixed to the cape 106. These connectors engage the helmet 102 or the track 122 only when the cape 106 is installed, and the removal of the cape 106 also removes these external connectors from the system.

In other examples, the external connectors are attached directly to the shell 104 of the helmet 102 or other structural elements of the helmet 102 besides the guide mechanism 108, which secure the cape 106. That is, the external connectors may secure the cape 106 independently of the track 122. Examples of such external connectors may include clips, straps, buttons, magnets, or other fasteners mounted to the helmet 102. In some cases, these external connectors may remain on the helmet 102 even after the cape 106 is removed.

External connectors are structurally and functionally distinct from the integrated connectors 112. The connectors that are removed along with the cape 106 or otherwise not permanently part of the track 122 are treated as external connectors, while connectors that remain in the track independently of the cape 106 are considered integrated connectors 112. In present implementations, the integrated connectors 112 may provide secure and consistent engagement with the track 122 of the rail 120. Unlike external connectors, integrated connectors 112 allow the cape 106 to slide and be repositioned without removal or detachment of the connector, ensuring stable coverage and reliable operation. This configuration improves usability, maintains functional positioning of the cape 106, and reduces the risk of inadvertent detachment or misalignment of the cape 106.

In present embodiments, the cape 106 is directly attachable to the guide mechanism 108 without requiring external mechanical connectors. In one embodiment, this is achieved by integrally forming the rail hook 114 with a cape attachment portion 116 configured to secure a fabric body of the cape 106 without separate hooks or fasteners. For present purposes, the cape 106 includes eyelets or attachment points (hereinafter, attachment points 118) that align with the one or more integrated mechanical connectors. Herein, the cape attachment portion 116 may comprise a loop, clip, or hook feature, formed as part of the rail hook 114, that allows direct connection to the fabric body of the cape 106 through the attachment points 118 on the cape 106. This design eliminates the need for separate components and simplifies attachment.

In some embodiments, the rail hook 114 comprises a quick-release design that enables tool-free detachment of the cape 106 from the helmet 102. This design allows users to quickly adjust, attach, or remove the cape 106 by sliding the rail hooks 114 out of the track 122 via the access opening. A user effectuates the detachment of the cape 106 by sliding the plurality of rail hooks 114 along the path defined by the track 122 until the rail hooks 114 align with the access opening 110. Once aligned, the rail hooks 114 may be withdrawn from the track 122 without the use of any tools. This action removes the cape 106 and the attached rail hooks 114 as a single unit from the helmet 102, facilitating rapid removal for storage, cleaning, or when shading is not required. Furthermore, the cape attachment portion of the rail hook 114 is configured to engage with the attachment points 118 on the cape 106 through a simple mechanical connection, such as a hook-and-eyelet interface, which also permits tool-free separation of the cape 106 from the rail hooks 114.

For present embodiments, the rail hook 114 is designed to be compatible with multiple types of cape fabric. This compatibility is a function of the mechanical nature of the connection between the rail hook 114 and the cape 106. The cape attachment portion of the rail hook 114 is configured to engage mechanically with the attachment points 118, such as eyelets, grommets, or integrated loops, that are physically incorporated into the fabric body of the cape 106. As this connection relies on physical structure rather than material-specific properties, the rail hook 114 can function with any fabric into which such attachment points 118 can be integrated.

Alternatively, the cape 106 may not require the attachment points 118, and the rail hook 114 is configured to penetrate, pinch, or pierce the cape 106 to secure it directly to the guide mechanism 108. In such implementations, the fabric of the cape 106 may be reinforced locally, or the hook may be shaped to distribute stress, thereby preventing tearing or excessive wear during use.

The rail hook 114 is also interchangeable with at least one connector selected from the group consisting of snap-fit connectors, slide clips, brackets, and loops, providing versatility in the connection system. This interchangeability allows the function of connecting the cape 106 to the helmet 102 to be accomplished by alternative mechanical components. For example, in an alternative configuration, the rail hook 114 itself could be substituted with a simple slide clip or a bracket that performs a similar guiding and attachment function. This modularity in the design of the connection system provides flexibility in manufacturing and allows the wearable protective apparatus 100 to be adapted for different use cases.

Figure 5A:
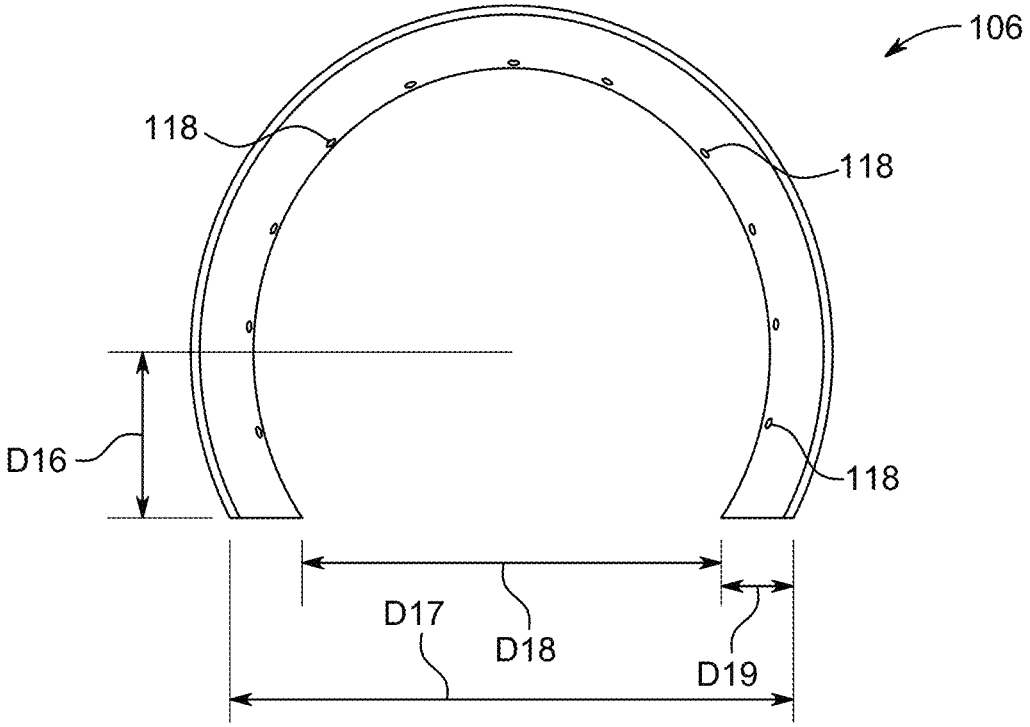
FIG. 5A is a top view of a cape of the wearable protective apparatus for outdoor workers, according to certain embodiments.
Figure 5B:
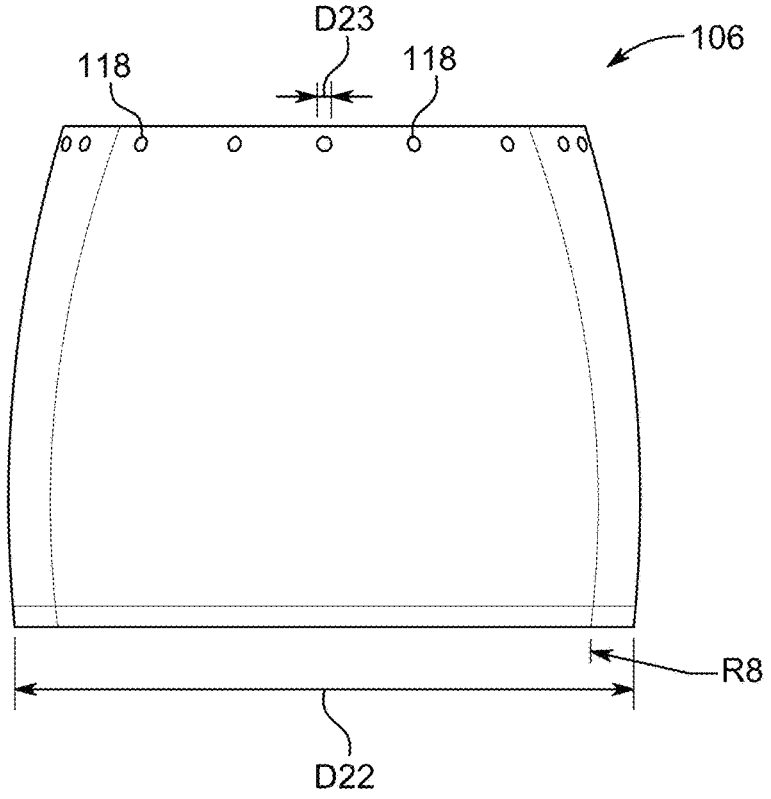
FIG. 5B is a front view of the cape of the wearable protective apparatus for outdoor workers, according to certain embodiments.
Figure 5C:
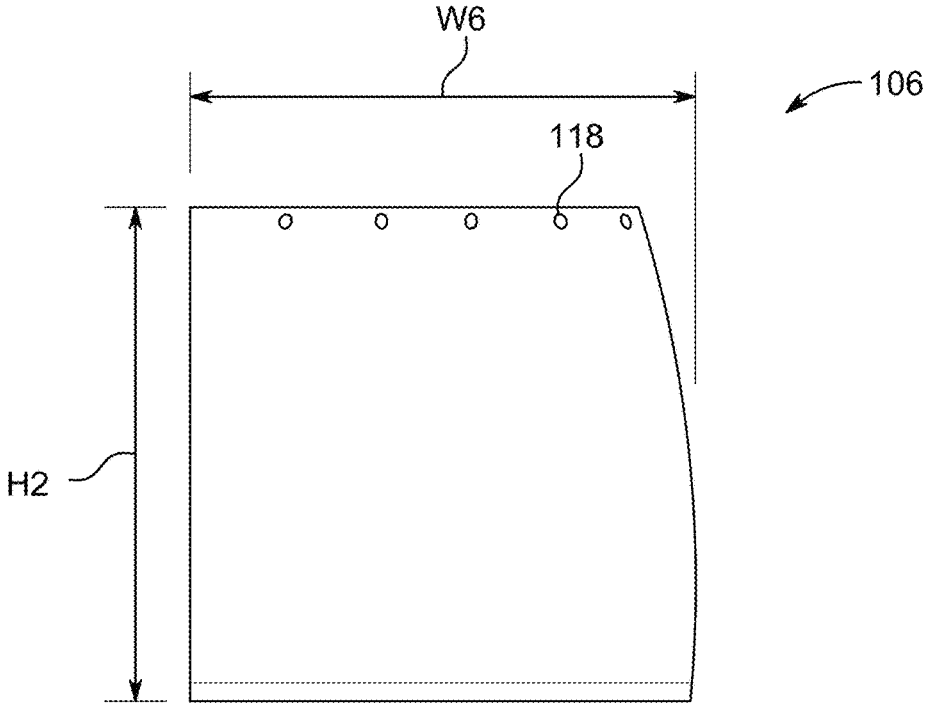
FIG. 5C is a side view of the cape of the wearable protective apparatus for outdoor workers, according to certain embodiments.

Referring now to FIGS. 5A, 5B, and 5C, different views of the cape 106 are illustrated. The cape 106 is configured to provide sun shading for the user. In present embodiments, the cape 106 comprises a soft, breathable fabric body. This fabric body drapes downward from the lower edge of the helmet 102 and extends across the neck, ears, face, and upper back region, depending upon user adjustment.

In some embodiments, the cape 106 is configured to be repositioned along the C-shaped semi-rigid track 122 to provide selective shading of different areas of the user's head and upper body. For example, the cape may be moved to the left side, the right side, or maintained at the rear of the helmet 102 depending on the position of the sun or the desired coverage. This adjustable positioning allows the user to customize shading of the head, neck, face, shoulders, and upper back region while maintaining attachment of the cape 106 to the helmet 102.

In certain embodiments, the cape 106 includes a front closure configured to secure the cape 106 around the user's face such that only the eyes of the user remain exposed. The closure may be achieved by fastening elements disposed on opposing edges of the cape 106, including but not limited to hook-and-loop fasteners (e.g., Velcro), buttons, snaps, or magnets. When engaged, the fastening elements draw the cape around the user's head and under the chin, thereby enclosing the face while leaving an opening aligned with the eyes. This configuration provides enhanced protection of the nose, mouth and cheeks from sunlight, wind, dust, or debris, while maintaining visibility for the user.

In some implementations, the cape 106 may be manufactured from a polyester mesh fabric. This material is lightweight, allowing the cape 106 to hang freely without creating excessive bulk. The polyester mesh fabric is breathable and allows airflow to pass through the mesh openings to reduce heat buildup under the shaded area. Additionally, the polyester mesh fabric is UV resistant. The polyester mesh fabric also provides a quick drying surface. Additionally, the polyester mesh fabric is durable and washable, while remaining flexible and foldable for compact storage, when not in use.

In present embodiments, the cape 106 may be contoured to maximize functional coverage while maintaining ergonomic compatibility. For instance, the cape 106 may have a narrower width along lateral edges and gradually widens toward the rear edges. The edges may be tapered or curved to conform to the user's body. The cape 106 may be configured to fit within a curved rail 120 extending end-to-end along a portion of the helmet 102 and may be selectively bunched or spread along the rail 120 according to desired user positioning. In an example configuration shown in FIGS. 5A-5C, the cape 106 has a curved shape, with a width 'W6' of approximately 247.53 mm, a height 'H2' of approximately 241.59 mm, and an outer edge length 'D22' of approximately 301.36 mm. The cape 106 may have an inner edge length 'D17' of approximately 203.56 mm and an overall inner width 'D18' of approximately 268.38 mm. Further, the cape 106 may have a radius of curvature 'R8' of approximately 524.5 mm. The integrated connectors 112, such as the rail hook 114, of the cape 106 are dimensioned to fit within the track 122 formed in the rail 120, such that the connectors remain engaged during sliding movement while permitting selective repositioning of the cape 106 along the rail 120.

In some embodiments, the cape 106 may have a width 'W6' within a range of about 200-300 mm, more preferably about 240-260 mm. The height 'H2' may be within a range of about 200-280 mm, more preferably about 230-250 mm. The outer edge 'D22' may be within a range of about 280-330 mm, more preferably about 295-310 mm. The inner edge length 'D17' may be within a range of about 180-240 mm, more preferably about 200-210 mm. The inner width 'D18' may be within a range of about 240-300 mm, more preferably about 260-275 mm. The radius of curvature 'R8' may be within a range of about 480-560 mm, more preferably about 510-540 mm.

As previously discussed, the cape 106 includes the plurality of attachment points 118. As shown in FIG. 5B, a spacing 'D23' between the attachment points 118 may be approximately 32.39 mm, and the attachment points 118 themselves may have a diameter 'D19' of approximately 2.5 mm. The attachment points 118, such as eyelets, snap buttons, grommets, or integrated loops, are configured to align precisely with the cape attachment portion 116 of the rail hooks 114. This alignment allows for tool-free installation and removal, enabling users to easily replace or clean the cape 106.

Figure 6:
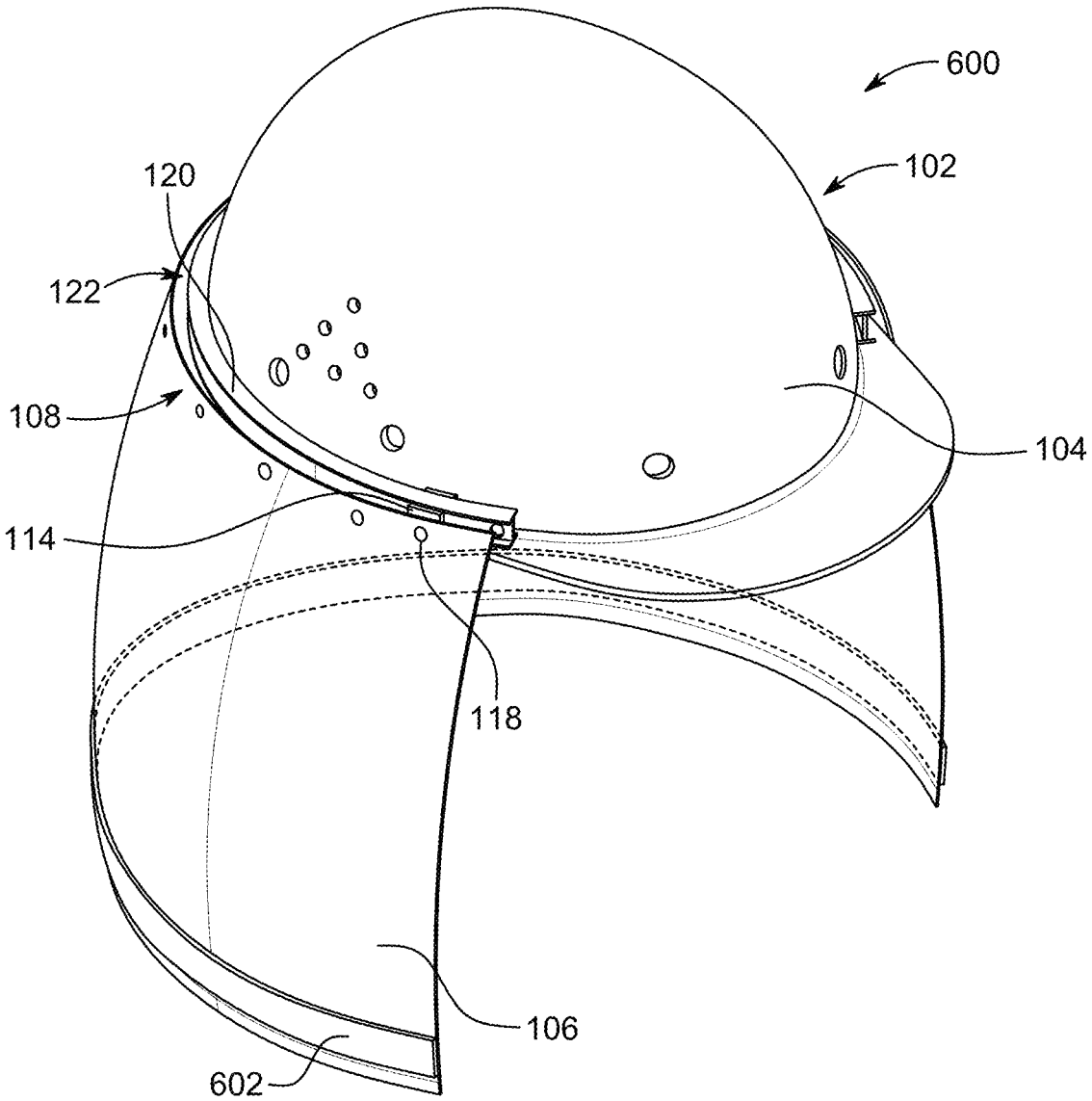
FIG. 6 is a perspective view of a wearable protective apparatus for outdoor workers with a reflective strip on a cape thereof, according to certain embodiments.

In some embodiments, as shown in an embodiment of a wearable protective apparatus (as represented by reference numeral 600) of FIG. 6, the cape 106 further comprises a reflective strip 602 disposed along a lower edge of the fabric body. The reflective strip 602 is applied to the fabric body of the cape 106 to enhance the visibility of the wearer in low-light or dim-lit environments, such as during early morning, late evening, or in shaded construction zones. The reflective strip 602 may be composed of a high-visibility material, such as prismatic reflective fabric, and may be stitched or heat-bonded along the lower edge of the cape 106.

As discussed, the guide mechanism 108 is integrated into the helmet 102 and the cape 106 is operably mounted on the guide mechanism 108. In the present embodiments, the guide mechanism 108 is configured to enable the cape 106 to slide or rotate around a major portion of a perimeter of the helmet 102 to selectively cover one or more of the user's neck, ears, face, and upper back region. Specifically, the guide mechanism 108, with its sliding and rotating functionality, allows the cape 106 to be configured to selectively cover only a portion of the user's neck, ears, face, or upper back based on user adjustment. A user can slide the rail hooks 114 along the C-shaped track 122 to adjust the position of the cape 106. This provides selective coverage based on sun direction, work orientation, and personal comfort requirements. For example, the cape 106 may be positioned to fully cover the neck area or shifted to shade the ears or sides of the head.

Figure 7:
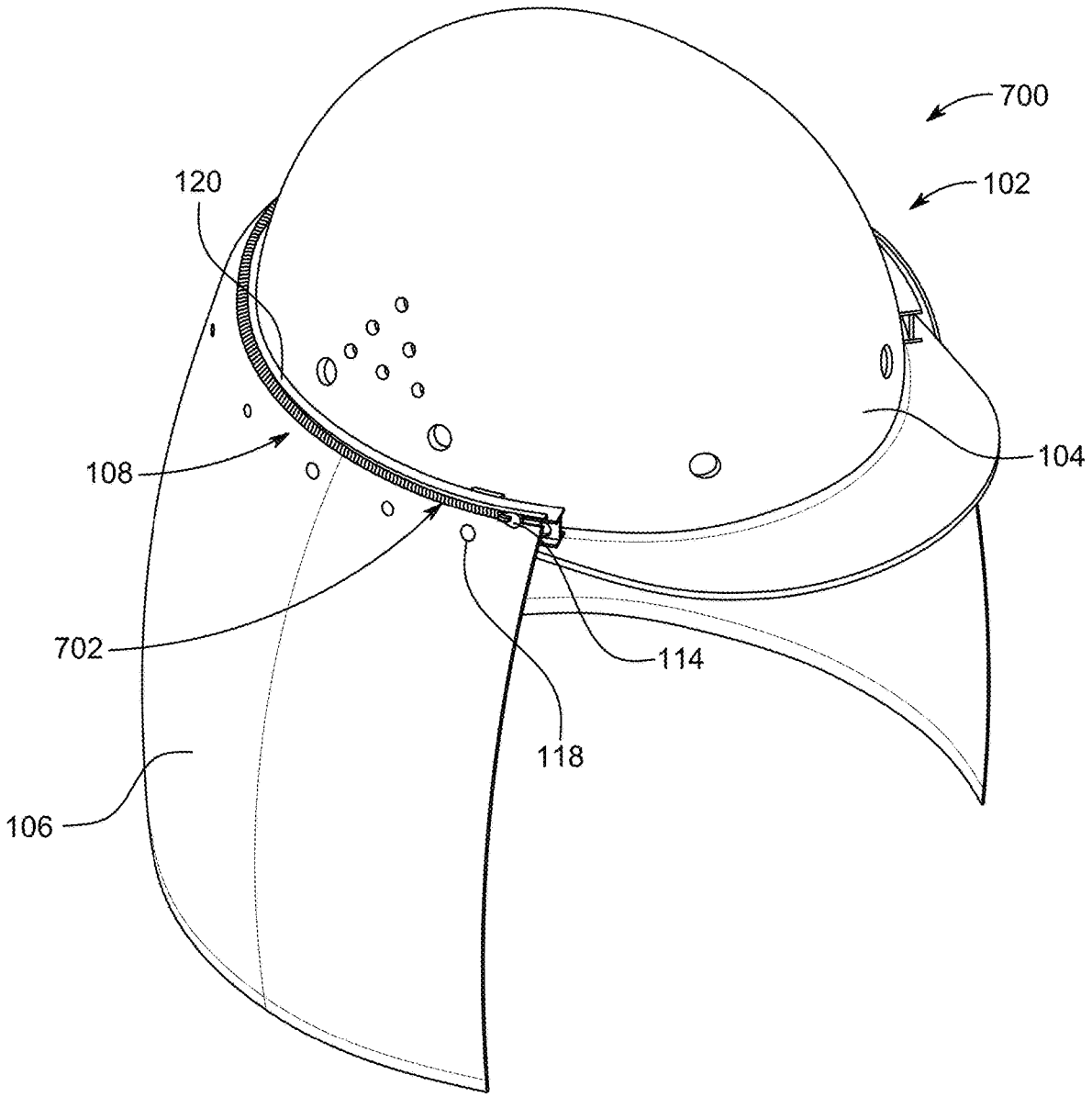
FIG. 7 is a perspective view of a wearable protective apparatus for outdoor workers with a positional locking feature for a guide mechanism therein, according to certain embodiments.

Referring now to FIG. 7, illustrated is an embodiment of a wearable protective apparatus (as represented by reference numeral 700), in which the guide mechanism 108 includes a positional locking feature 702. Herein, the cape 106 is movable to a fixed position around the helmet 102 using the positional locking feature 702 of the guide mechanism 108. The positional locking feature 702 prevents the one or more rail hooks 114 or the cape 106 from accidentally sliding out of position. For instance, if a user bends forward or turns their head quickly, the positional locking feature 702 secures the cape 106. In one embodiment, the positional locking feature 702 comprises a locking feature or an integrated clip formed at one or both ends of the track 122. This integrated clip holds the one or more rail hooks 114, and the user can individually release each rail hook 114 by disengaging the corresponding clip. In some implementations, the positional locking features 702 may work in combination with the guide mechanism 108 which may include one or more detents, stops, or frictional elements along the track 122 to selectively retain the cape 106 in a predetermined position.

Figure 8:
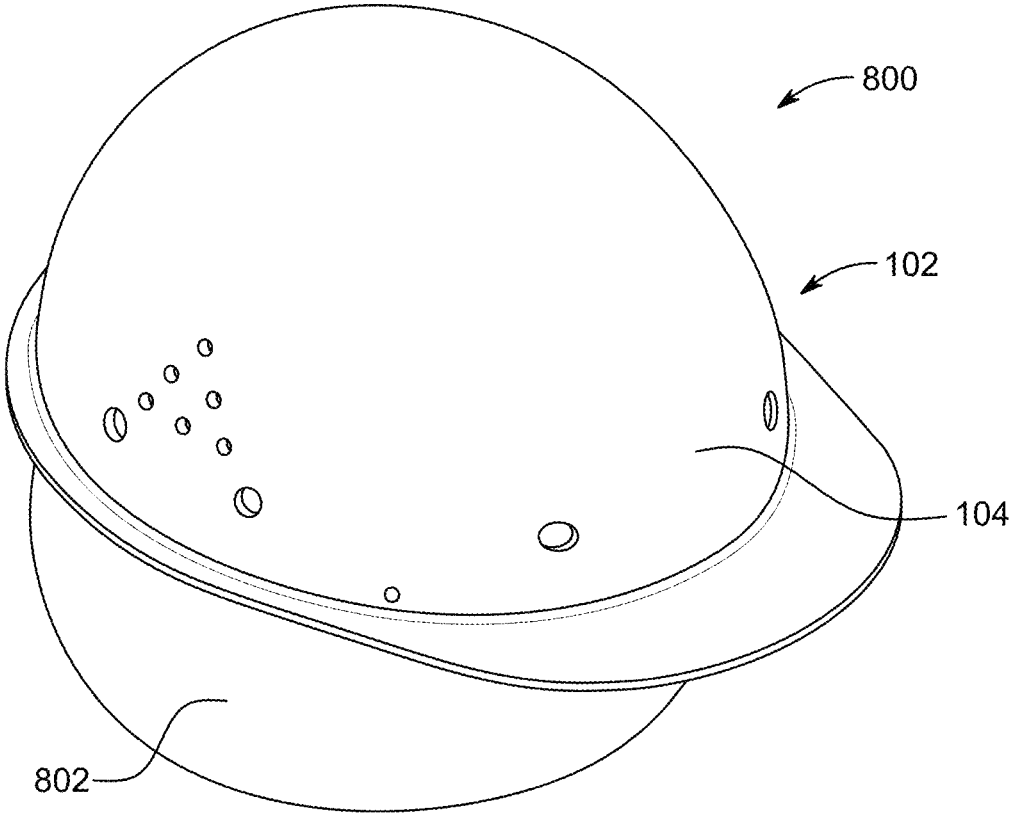
FIG. 8 is a perspective view of a wearable protective apparatus for outdoor workers with a storage compartment, according to certain embodiments.

Further referring to FIG. 8, illustrated is an embodiment of a wearable protective apparatus (as represented by reference numeral 800), comprising a storage compartment 802 integrated within the rigid shell 104. In present embodiment, the storage compartment 802 is positioned along the perimeter of the rigid shell 104. The storage compartment 802 has sufficient volume to contain the cape 106 when not in use. The storage compartment 802 provides convenient storage without requiring complete removal of the cape 106 from the helmet 102, allowing a user to quickly retract and store the cape 106 during indoor work or breaks. It may be appreciated that the cape 106 remains immediately available for use when outdoor sun protection becomes necessary. In some implementations, the storage compartment 802 may be equipped with one or more fasteners (e.g., Velcro, magnets, button, stud closures, snap fasteners) configured to securely store the cape 106 when not in use.

In an exemplary mode of operation, a user attaches the cape 106 to the helmet 102 by inserting the plurality of rail hooks 114, which are secured to the cape 106, into the access opening 110 of the track 122. Once the rail hooks 114 are engaged within the track 122, the user may slide the rail hooks 114 along the track 122, thereby moving the cape 106 linearly and rotationally along the perimeter of the helmet 102. The position of the cape 106 is adjustable through this sliding motion, which allows for selective coverage of the user's neck, ears, or upper back based on factors such as the direction of the sun, the user's work orientation, or personal comfort requirements. The cape 106 may be detached from the helmet 102 by sliding the rail hooks 114 back towards and out of the access opening 110, an action which is facilitated by the tool-free, quick-release design of the rail hook 114 and the guide mechanism 108.

In various alternative embodiments, the materials for the components can be varied. For example, the rigid shell 104 could also be made of fiberglass or other advanced composites. The cape 106 could be made from other breathable and durable fabrics such as ripstop polyester or have a multi-layer construction, for example, with a moisture-wicking inner layer and a water-resistant outer layer. The guide mechanism 108 and rail hooks 114 could be made from other durable, low-friction polymers or lightweight metals, depending on the desired performance characteristics.

The configuration of the components may also vary. The curved rail 120 could extend around a smaller or larger portion of the helmet's perimeter. The number of rail hooks 114 used to attach the cape 106 can be adjusted to provide more or less support. The shape and size of the cape 106 can be modified to provide different levels and styles of coverage to suit different user preferences or specific work environments.

The wearable protective apparatus 100 of the present disclosure incorporates a mechanical configuration that facilitates user control over the extent and position of environmental protection provided by the cape 106. The integration of the guide mechanism 108 into the helmet 102 creates a unified protective system that maintains the structural integrity of the helmet 102 while providing adjustable coverage capabilities. The direct attachment capability of the cape 106 to the guide mechanism 108 eliminates the need for separate hardware components, reducing complexity and maintenance requirements for users in construction environments.

The wearable protective apparatus 100 provides a significant functional advancement by integrating the guide mechanism 108 directly with the helmet 102. This configuration creates a unified system where the cape 106 is not merely an accessory but an operable component of the apparatus 100. The ability for the cape 106 to slide or rotate around a major portion of the perimeter of the helmet 102 provides a level of dynamic, user-controlled adjustability. This allows the protective coverage to be positioned in response to environmental variables, such as the angle of the sun, throughout a workday.

Numerous modifications and variations of the present disclosure are possible in light of the above teachings. It is therefore to be understood that within the scope of the appended claims, the invention may be practiced otherwise than as specifically described herein.

The invention claimed is:

1. A wearable protective apparatus for outdoor workers, comprising:

a helmet having a rigid shell configured to protect a user's head;

a cape configured to provide sun shading for the user;

a guide mechanism integrated into the helmet, the cape being operably mounted on the guide mechanism;

wherein the guide mechanism is configured to enable the cape to slide or rotate around a major portion of a perimeter of the helmet to selectively cover one or more of the user's neck, ears, face, or upper back region; and wherein the cape is directly attachable to the guide mechanism without requiring external mechanical connectors, wherein the guide mechanism comprises a curved rail extending along a rear and lateral portion of the rigid shell, the curved rail defining a semicircle having ends and an apex, wherein the curved rail includes an upward bend out of a plane defined by the ends of the semicircle, the upward bend beginning at a point at least three-quarters of a distance from one of the ends of the curved rail towards the apex of the semicircle.

2. The wearable protective apparatus of claim 1, wherein the curved rail includes an access opening configured for inserting or removing the cape.

3. The wearable protective apparatus of claim 1, wherein the curved rail includes one or more integrated mechanical connectors selected from the group consisting of brackets, snap-fit connectors, loops, slide clips, hooks, including a rail hook.

4. The wearable protective apparatus of claim 3, wherein the cape includes eyelets or attachment points that align with the one or more integrated mechanical connectors.

5. The wearable protective apparatus of claim 1, wherein the cape comprises a soft, breathable fabric body.

6. The wearable protective apparatus of claim 5, wherein the cape further comprises a reflective strip disposed along a lower edge of the fabric body.

7. The wearable protective apparatus of claim 1, wherein a rail hook is configured to slide along the curved rail of the guide mechanism.

8. The wearable protective apparatus of claim 7, wherein the rail hook is integrally formed with a cape attachment portion configured to secure a fabric body without separate hooks or fasteners.

9. The wearable protective apparatus of claim 8, wherein the rail hook comprises a quick-release design that enables tool-free detachment of the cape from the helmet.

10. The wearable protective apparatus of claim 8, wherein the rail hook is compatible with multiple types of cape fabric.

11. The wearable protective apparatus of claim 7, wherein the rail hook is interchangeable with at least one connector selected from the group consisting of snap-fit connectors, slide clips, brackets, and loops.

12. The wearable protective apparatus of claim 1, further comprising a storage compartment integrated within the rigid shell.

13. The wearable protective apparatus of claim 12, wherein the storage compartment is positioned along the perimeter of the rigid shell.

14. The wearable protective apparatus of claim 12, wherein the storage compartment has sufficient volume to contain the cape when not in use.

15. The wearable protective apparatus of claim 1, wherein the guide mechanism comprises a track that allows both linear sliding and rotational movement of the cape.

16. The wearable protective apparatus of claim 15, wherein the track is substantially C-shaped.

17. The wearable protective apparatus of claim 1, wherein the cape is configured to selectively cover only a portion of the user's neck, ears, face, or upper back based on user adjustment.

18. The wearable protective apparatus of claim 1, wherein the cape is movable to a fixed position around the helmet using a positional locking feature of the guide mechanism.

19. The wearable protective apparatus of claim 1, wherein the guide mechanism is integrally molded into the helmet shell.

* * * * *